US005662506A

United States Patent [19]

Reinhardt, Jr. et al.

[11] Patent Number: 5,662,506

[45] Date of Patent: Sep. 2, 1997

[54] RAFT WITH WATER DISPLACING FLOOR AND METHOD THEREFOR

[75] Inventors: Kenneth G. Reinhardt, Jr., Coral Springs; Dennis Liong, Parkland, both of Fla.

[73] Assignee: Hoover Industries, Inc,, Miami, Fla.

[21] Appl. No.: 661,066

[22] Filed: Jun. 10, 1996

[51] Int. Cl.[6] ..... B63B 35/58

[52] U.S. Cl. ..... 441/40; 114/345

[58] Field of Search ..... 114/345, 346, 114/348, 349; 441/40, 43, 129–131

[56] References Cited

U.S. PATENT DOCUMENTS

| | | | |
|---|---|---|---|
| 1,619 | 5/1840 | Porter | 441/109 |
| 2,391,906 | 1/1946 | Kearny | 114/345 |
| 4,216,559 | 8/1980 | Switlik, Jr. | 441/40 |

FOREIGN PATENT DOCUMENTS

| | | | |
|---|---|---|---|
| 56608 | 8/1924 | France | 441/40 |
| 1380674 | 10/1964 | France | 114/345 |
| 242074 | 11/1925 | United Kingdom | 114/345 |
| 331312 | 7/1930 | United Kingdom | 441/43 |

*Primary Examiner*—Edwin L. Swinehart
*Attorney, Agent, or Firm*—Robert C. Kain, Jr.

[57] ABSTRACT

The raft with a water displacing floor includes at least one peripherally disposed, inflatable tube. The raft includes a flexible floor which has a larger spatial area than the spatial area of the raft when the peripheral tube is inflated. The floor is attached to the raft along the floor's peripheral regions. When the raft is in an elevated, horizontal, free-standing position, a lower region of the floor hangs at least a distance fifty percent greater than the vertical cross-sectional dimension of the inflated peripheral tube. In other embodiments, the floor hangs a distance more than the vertical cross-sectional dimension of the inflated tube. The raft can be configured using two vertically stacked peripheral tubes. In such construction, the floor is attached at the interface between the two vertically stacked tubes. The method of enhancing the buoyancy of the raft includes buoyantly supporting at least fifty percent of the loaded raft with a displacement of water caused by the floor. For a single tube raft, the floor contributes at least eighty percent of the total buoyancy of the raft by the displacement of water.

10 Claims, 5 Drawing Sheets

RAFT WITH WATER DISPLACING FLOOR AND METHOD THEREFOR

The present invention relates to a raft with an oversized floor which displaces water and a method for enhancing the buoyancy of a raft.

BACKGROUND OF THE INVENTION

Commonly, life-saving rafts are stored in an uninflated condition on aircraft, ships and boats. Particularly on aircraft, the packing size and the weight of the raft is a consideration.

With respect to rafts carried by aircraft, the weight of the raft can be reduced by enhancing the buoyancy of the floor of the fully loaded raft.

Prior art rafts incorporate pre-existing technology wherein the floor of the raft is taut. These rafts commonly include a peripherally disposed, inflatable tube and a floor which is kept taut or flat over the interior space defined by the tube. The floor has a spatial area generally equivalent to the spatial area of the raft when the peripheral tube is inflated.

Further, rafts carried by aircraft commonly utilize two, vertically stacked peripheral tubes. This prior art raft includes a floor which is taut or flatly disposed between the upper and lower vertically stacked, peripheral tubes.

OBJECTS OF THE INVENTION

It is an object of the present invention to provide a raft with a water displacing floor.

It is a further object of the present invention to provide a raft with a water displacing floor whereby the floor provides at least fifty percent of the total buoyancy of a two-robe raft and at least eighty percent of the total buoyancy of a single tube raft.

It is an additional object of the present invention to provide a raft wherein the floor has a larger spatial area than the spatial area of the raft when the peripheral inflatable tubes are inflated.

It is another object of the present invention to provide a raft wherein the floor hangs a distance at least fifty percent greater than the vertical cross-sectional dimension of the inflated peripheral tube when the raft is in a horizontal, free-standing position.

It is an additional object of the present invention to provide a method of enhancing the buoyancy of the raft by utilizing a floor with a spatial area greater than the spatial area of the raft and wherein the floor buoyantly supports at least fifty percent of the loaded two-tube raft or eighty percent of the loaded single tube raft with the displacement of water.

It is another object of the present invention to provide a raft wherein the weight of the raft assembly can be reduced by increasing the spatial area of the floor (and hence, the buoyancy) which, in turn, permits the lower region of the floor to hang increasingly greater distances below the floor—peripheral tube attachment region. This permits the use of smaller tubes and a smaller inflation system, which results in less weight and size which is attractive to aircraft operators.

It is another object of the present invention to provide a water displacing floor for both a single peripheral tube raft as well as a double peripheral tube raft.

SUMMARY OF THE INVENTION

The raft with a water displacing floor includes at least one peripherally disposed, inflatable tube. The raft includes a flexible floor which has a larger spatial area than the spatial area of the raft when the peripheral tube is inflated. The floor is attached to the raft along the floor's peripheral regions. When the raft is in an elevated, horizontal, free-standing position, a lower region of the floor hangs at least a distance fifty percent greater than the vertical cross-sectional dimension of the inflated peripheral tube. In other embodiments, the floor hangs a distance more than the vertical cross-sectional dimension of the inflated tube. The raft can be configured using two vertically stacked peripheral tubes. In such construction, the floor is attached at the interface between the two vertically stacked tubes. The method of enhancing the buoyancy of the raft includes buoyantly supporting at least fifty percent of the loaded raft with a displacement of water caused by the floor. For a single tube raft, the floor contributes at least eighty percent of the total buoyancy of the raft by the displacement of water.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a raft with a water displacing floor and a method therefor.

Figure 1:
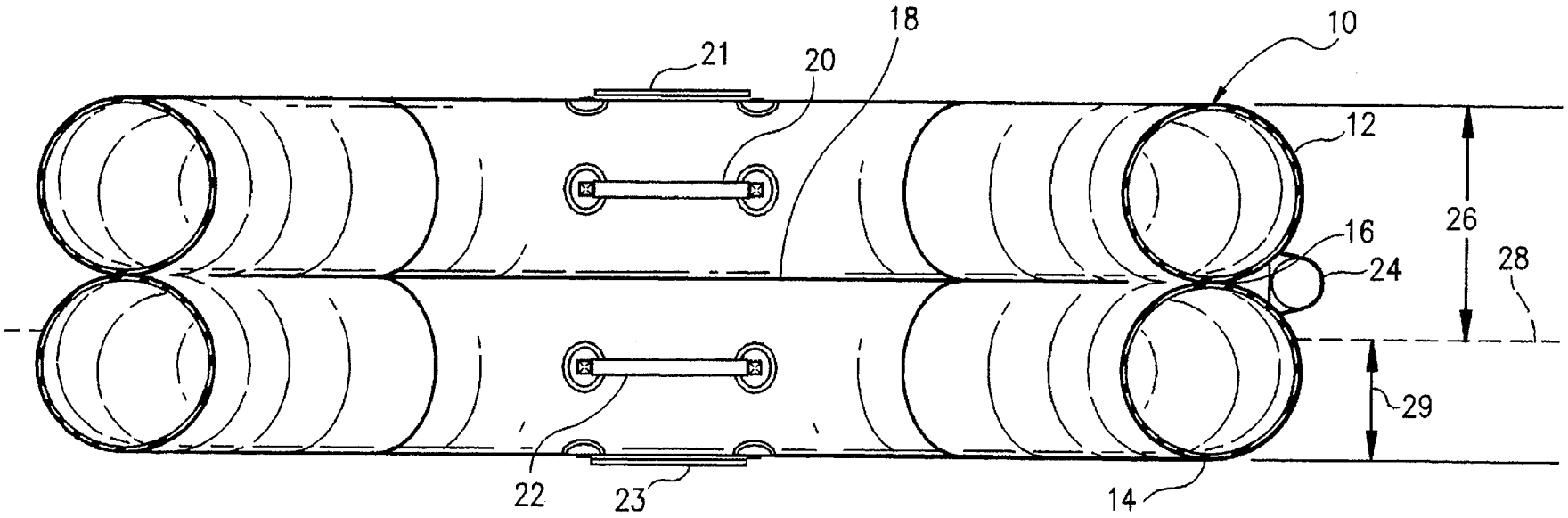
FIG. 1 Prior Art
FIG. 1 diagrammatically illustrates the prior art double tube raft with a taut floor.

FIG. 1 diagrammatically illustrates a pre-existing or prior art device which is configured as a double tube raft 10. Raft 10 includes an upper, peripherally disposed, inflatable tube 12 and a lower, peripherally disposed inflatable tube 14. Tube 12 is attached to tube 14 at interface 16. A floor 18 is attached to upper tube 12 and lower tube 14 along the tubes' interface 16. Double tube raft 10 includes a number of safety features including handles 20, 21, 22 and 23. Additional life-saving equipment and/or inflation mechanisms 24 are provided on raft 10.

In a loaded condition, raft 10 has a free board shown by distance 26 above waterline 28. Lower tube 14 is partially submerged a distance 29 beneath the water.

Governmental regulations require that life-saving rafts carried by aircraft have the following performance characteristics:

1. For a double tube raft wherein both tubes are fully inflated and the raft is fully loaded to capacity, there must be 12 inches of free board. Free board is the distance between the upper surface of the top tube and the surface of the water.

2. For double tube rafts when the critical or top tube is completely deflated, and the raft is fully loaded to capacity, there must be at least 6 inches of free board.

3. In an overloaded condition, which is defined as fifty percent over capacity (for example, a six man raft carrying nine men), there must be some measurable free board.

Government regulations specify that with respect to six man rafts, each man weighs 170 pounds. Accordingly, a fully loaded six man raft must meet the above noted performance guidelines when carrying 1,020 pounds.

With the continual enhancements to aircraft and the need to reduce weight without sacrificing safety, the total weight of a life raft may be a factor. Common life rafts are made of neoprene coated fabric, which has an approximate weight factor of 0.5 pounds per square yard. The load carried by the raft can be increased if the size of the raft is increased or if the size of the tubes is increased. However, if the size of the inflatable tubes are increased, there is a significant weight gain associated with increasing the size of the tubes. If the rafts can be configured to carry larger loads within the parameters specified by the government without increasing the tube size or carrying a given load while decreasing the tube size, the total weight of the raft on the airplane may be reduced.

The present invention enhances the buoyancy of a raft by utilizing a floor which has a larger spatial area than the spatial area of the raft such that the floor, when the raft is fully or partially loaded, displaces water. The displacement of water by the floor contributes significantly to the total buoyancy of the raft. See FIG. 2.

It is well established that the buoyancy or load bearing ability of an object is related to the amount of water displaced by the object multiplied by the specific gravity or other physical characteristics of the water displaced.

Figure 2:
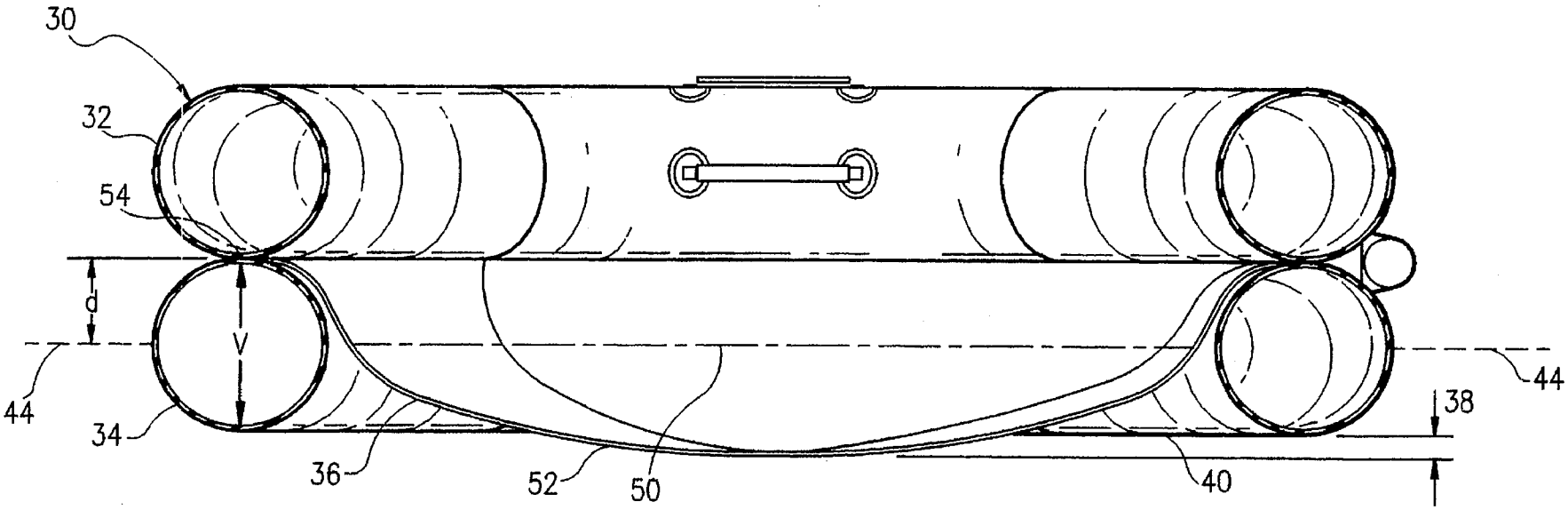
FIG. 2 diagrammatically illustrates the raft with a water displacing floor in accordance with the principles of the present invention.

FIG. 2 diagrammatically illustrates one embodiment of the present invention with a double tube raft 30. The double tube raft includes a top peripheral tube 32, a bottom peripheral tube 34, and a flexible floor 36. Additional safety items are illustrated in FIG. 2 as is common in the industry. Floor 36 has a much larger spatial area than the spatial area of the raft (the area within the inflated tubes) since the floor flops down or hangs a distance 38 beneath the lower surface 40 of lower tube 34. When raft 30 is placed in the water and is fully loaded, the waterline is established at line 44. Floor 36 displaces a volume of water beneath waterline 44 and generally equivalent to the volume represented by the area below the dashed and dotted line 50. In this manner, the floor 36 contributes at least fifty percent of the total buoyancy of the two-tube raft and hence the raft can hold a greater load than the prior art raft shown in FIG. 1.

Studies have shown that floor 36 must have a lower region 52 which hangs at least fifty percent of the vertical dimension v below the floor and tube attachment interface 54. In other words, lower region 52 of floor 36 must be greater than distance d which is generally equivalent to fifty percent of the vertical cross-sectional dimension v of one of the inflated peripheral tubes.

Figure 3:
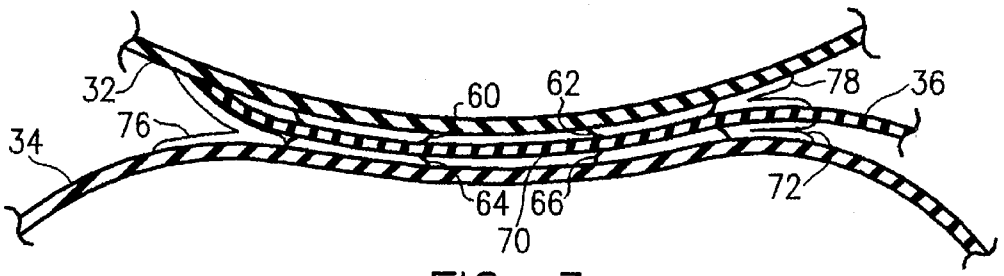
FIG. 3 diagrammatically illustrates the attachment of the floor to the double tube raft.

FIG. 3 shows a conventional method of attaching floor 36 to upper tube 32 and lower tube 34. Certain spaces have been added to FIG. 3 to clarify the various layers of construction. Tape regions are built up on the upper and lower tubes as tape regions 60, 62, 64 and 66 on upper tube 32 and lower tube 34, respectively. The peripheral region 70 of floor 36 is first glued to or adhered to one of the upper or the lower tubes. Tape 72 is applied to seal the interface between floor 36 and tube 34. Thereafter, the upper tube 32 is adhered to both lower tube 34 by web 76 and also to floor 36 by web 78. Other types of conventional attachment mechanisms and systems can be used to attach floor 36 to one or more inflatable peripheral tubes.

Figure 4:
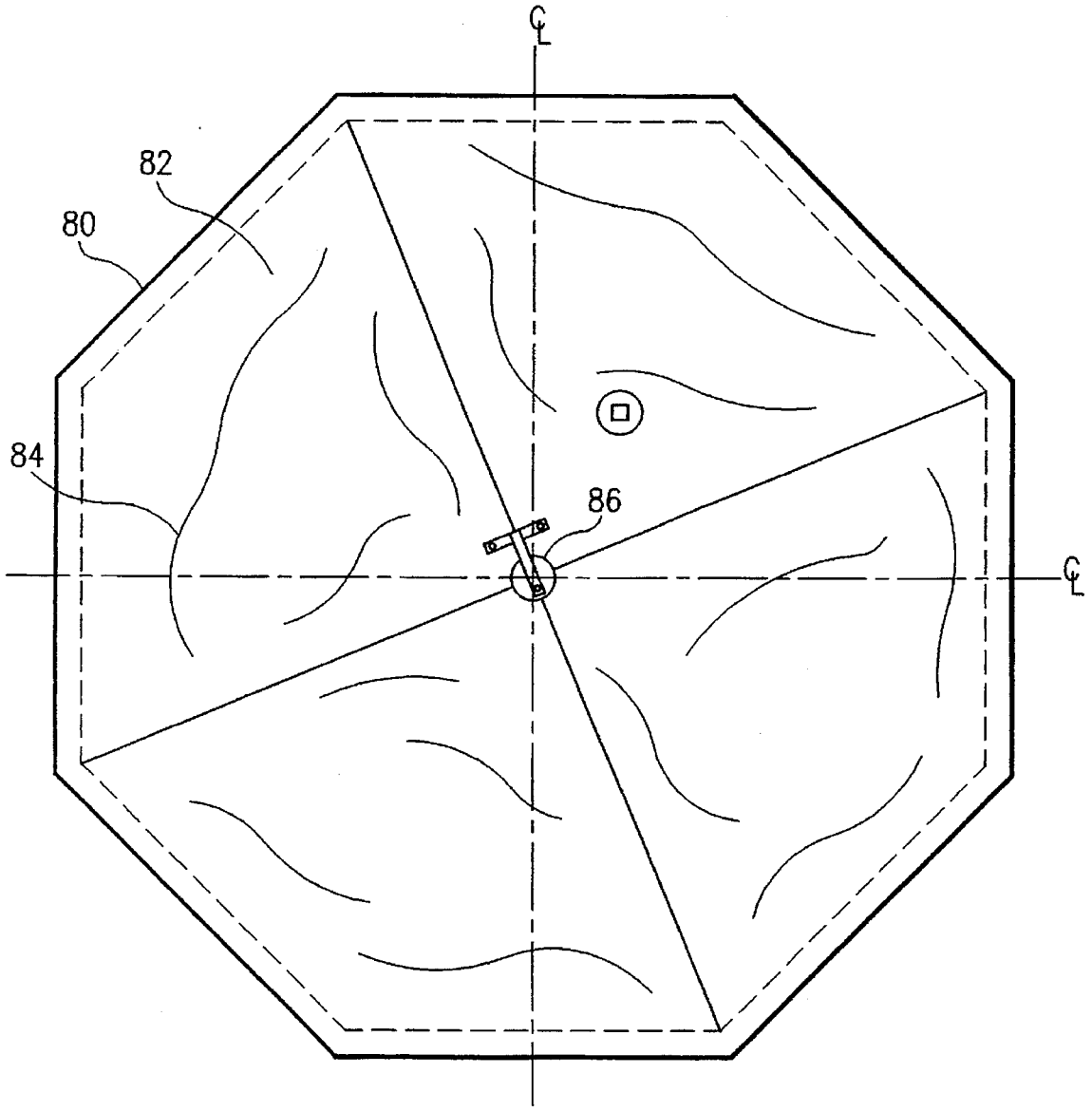
FIG. 4 diagrammatically illustrates a top view of the floor of a six-man, double tube raft in accordance with the principles of the present invention.

FIG. 4 diagrammatically illustrates floor 80. Floor 80 is a larger surface spatial area 82 than the total spatial area of the raft. In general, the spatial area of the raft is the area circumscribed by the inflated peripheral tubes. Further, the flexible floor is larger than the spatial area of the raft and this larger surface area of the floor causes the floor to flop or hang. This flop or hang is shown by curvaceous lines 84 in FIG. 4. Other features such as a canopy mast attachment and tie down patch 86 may be included in the floor.

Figure 5:
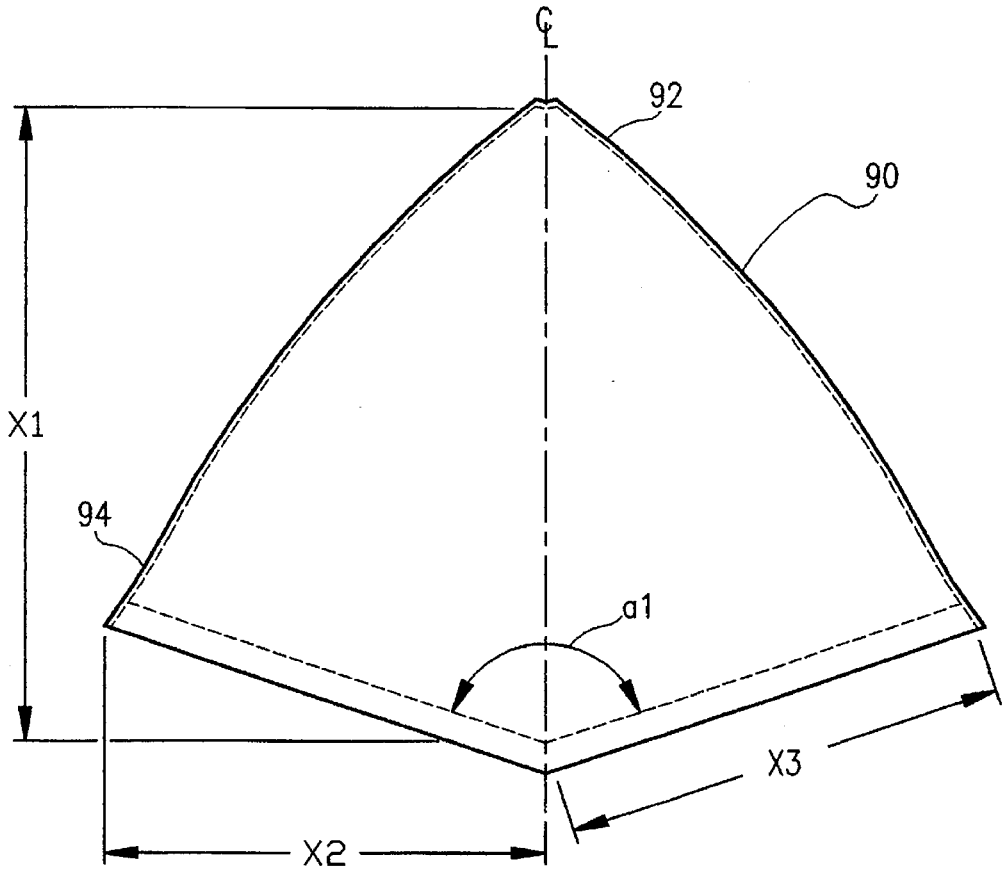
FIG. 5 diagrammatically illustrates a section of the floor.

FIG. 5 diagrammatically illustrates one section 90 of the floor. The floor is made in sections and has very large curves at edge 92 and smaller curves at edge 94. The floor is made in sections because generally the rafts are octagonal shaped, although other polygonal shapes may be used. Seams are denoted as dashed lines in FIG. 5.

The following exemplary dimension table for the floor section provides some indication of the size for a six man raft.

Exemplary Dimension Table for Floor Section
(All Dimensions Approximate)

| | | |
|---|---|---|
| Radial seam | | 0.5 inches |
| Peripheral seam | | 2.0 inches |
| Distance | × 1 | about 40 inches |
| | × 2 | about 30 inches |
| | × 3 | about 30 inches |
| Angle al | | 130–140° |

Figure 6:
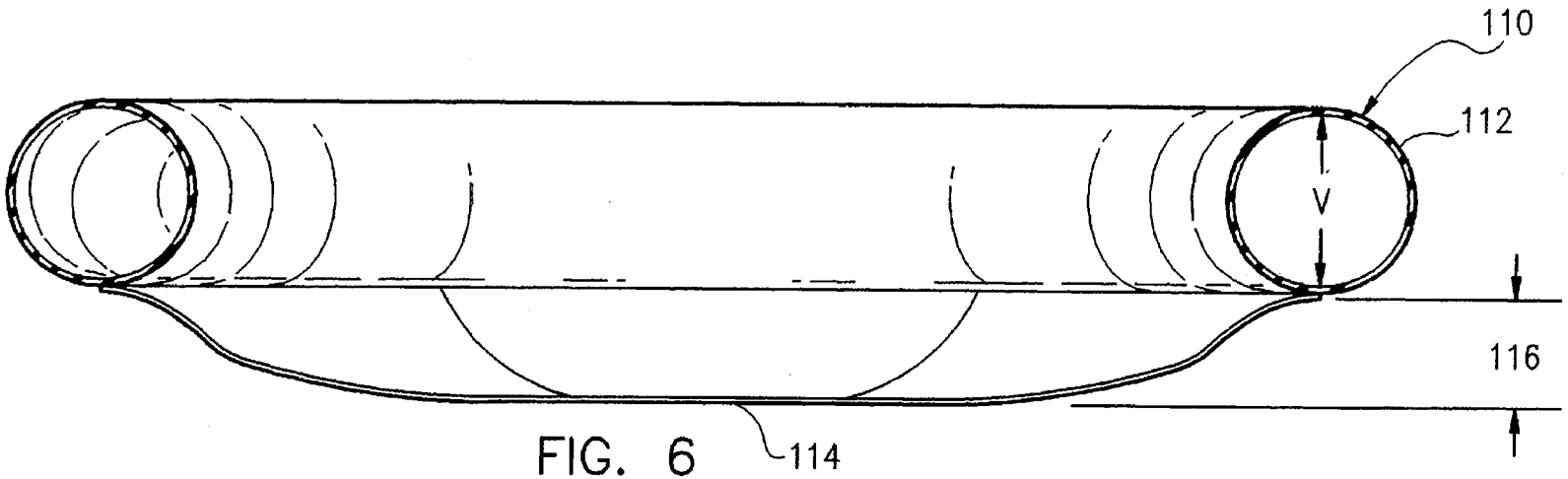
FIGS. 6 and 7 diagrammatically illustrate further embodiments of the raft with a water displacing floor.

FIG. 6 diagrammatically illustrates a single tube raft 110 having a single inflated peripheral tube 112. Floor 114 hangs a distance 116 exceeding at least fifty percent of the vertical cross-sectional dimension v of the inflated tube 112. As such, the floor 114 displaces a significant amount of water and provides at least eighty percent of the total buoyancy of the raft when the raft is loaded and is floating. In FIGS. 2, 6, 7 and 8, the flexible floor and the raft is shown in a horizontal, free-standing position. This horizontal, free-standing position can be achieved by simply placing the bottom tube of each raft above a floor elevation and letting the floor of the raft (for example floor 52 of raft 30 in FIG. 2) hang below the horizontally disposed and free-standing raft.

Figure 7:
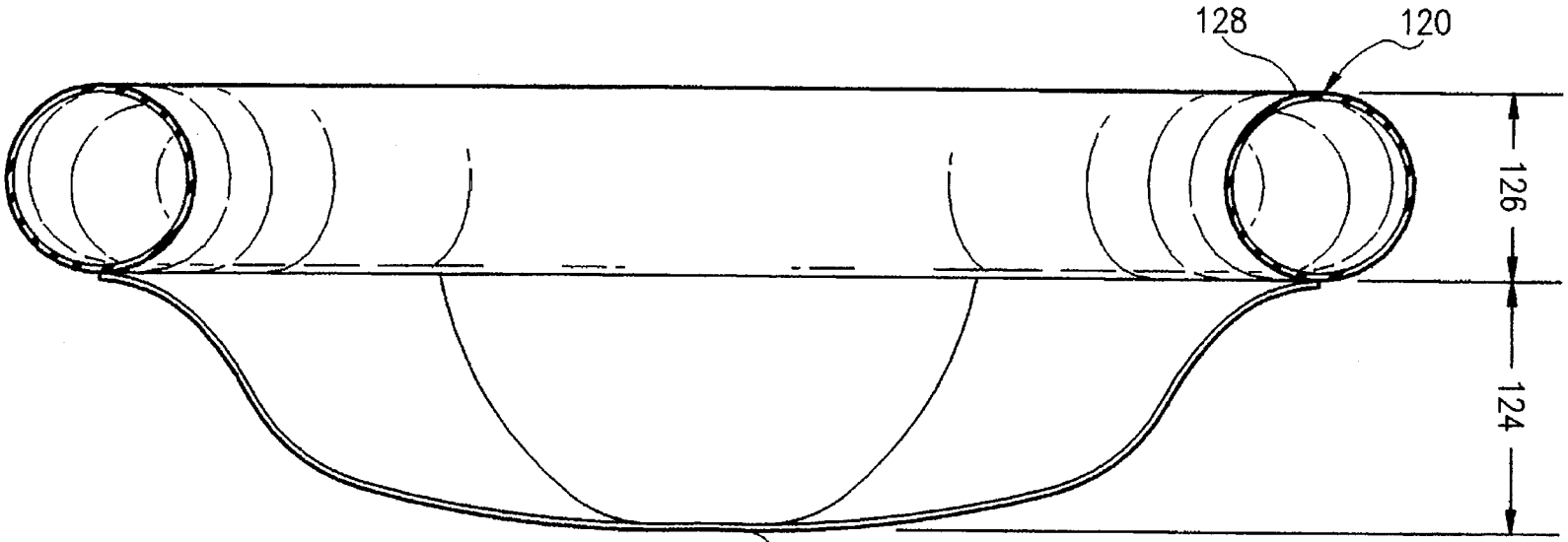

FIG. 7 diagrammatically illustrates a single tube raft 120. Floor 122 hangs a distance 124 which exceeds the vertical dimension 126 of inflated tube 128. In this configuration, the amount of water displaced by floor 122 is significantly greater than that in FIG. 6.

Figure 8A:
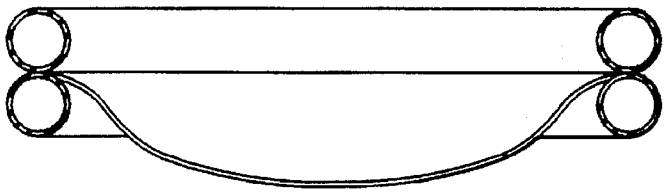
FIGS. 8A, B and C diagrammatically illustrate various floor configurations all capable of displacing water and providing buoyancy to the loaded raft.
Figure 8B:
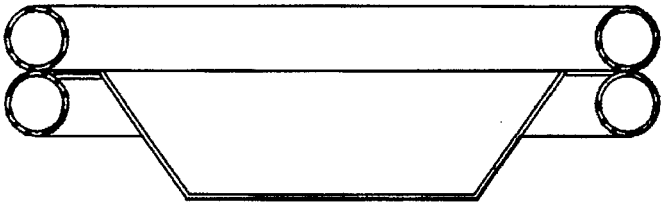
Figure 8C:
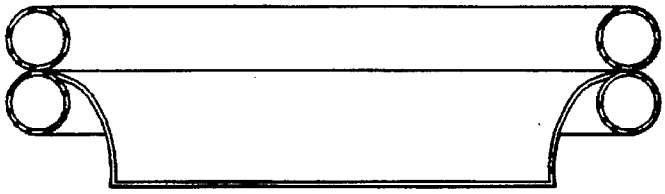

FIGS. 8A, 8B and 8C diagrammatically illustrate the floor in a bowl configuration (FIG 8A), in a truncated conical section (FIG. 8B) and in a general rectangular configuration (FIG. 8C). In all of these situations, the floor hangs at least fifty percent of the tube cross-sectional dimension below the attachment region to the tube and further the floor provides at least fifty percent of the total buoyancy of the two-tube raft when the raft is loaded.

Experiments have been conducted on embodiments of the present invention. The following tables show a single tube, six man raft with the deck side up. A single tube six man raft was utilized and was loaded as shown by the weight column on the far left of the table. The free board height was measured at each load level. The tube data shown by cross-sectional area, volume displacement and buoyancy force is calculated based upon the free board height and the known or computed size of the tube. The floor data buoyancy force is computed based upon the difference between the tube data buoyancy force and the weight load. The volume displaced by the floor and the buoyancy percentage from the floor is calculated based upon the buoyancy force. The volume displaced is mathematically calculated from the buoyancy force based upon the specific gravity or other physical parameter of water. Some information in these tables were computed rather than measured.

The most definitive way to describe the shape under water is to assume that the shape is a shallow octagonal cone with a volume of 10.55 cubic feet, height under water is approximately 12.8 inches and the base width at waterline is approximately 50 inches. This was determined from calculations of related data determined experimentally. The theoretical calculated total volume of the bowl is 22 cubic feet. The bottom of the bowl will actually be approximately 7.8 inches below the bottom of the lower buoyancy tube. These dimensions will vary for rafts of different capacities.

Single Tube Six Man Raft Deck Side Up

| Measured Data | | | Tube Data | | | Floor Data | |
|---|---|---|---|---|---|---|---|
| Weight (lbs.) | Freeboard Height (in.) | X-Section Area in (sq. in.) | Volume Displaced (cu. ft.) | Buoyancy Force (lbs.) | Buoyancy Force (lbs.) | Volume Displaced cu. ft. | Bouyancy From Floor % |
| 158.00 | 8.97 | 17.16 | 2.39 | 148.91 | 9.09 | 0.14607 | 5.76 |
| 310.00 | 7.81 | 28.98 | 4.04 | 251.47 | 58.53 | 0.940032 | 18.88 |
| 496.00 | 6.84 | 39.71 | 5.53 | 344.58 | 151.42 | 2.43201 | 30.53 |
| 662.00 | 6.16 | 47.55 | 6.63 | 412.61 | 249.39 | 4.005549 | 37.67 |
| 840.00 | 4.59 | 65.46 | 9.12 | 568.03 | 271.97 | 4.368321 | 32.38 |
| 1040.00 | 3.88 | 73.44 | 10.24 | 637.27 | 402.73 | 6.468444 | 38.72 |

Single Tube Six Man Raft Deck Side Down

| Measured Data | | | Tube Data | | | Floor Data | |
|---|---|---|---|---|---|---|---|
| Weight (lbs.) | Freeboard Height (in.) | X-Section Area in (sq. in.) | Volume Displaced (cu. ft.) | Buoyancy Force (lbs.) | Buoyancy Force (lbs.) | Volume Displaced cu. ft. | Bouyancy From Floor % |
| 158.00 | 10.53 | 4.33 | 0.60 | 37.57 | 120.43 | 1.934251 | 76.22 |
| 310.00 | 10.06 | 13.96 | 1.95 | 121.14 | 188.86 | 3.033445 | 60.92 |
| 496.00 | 9.06 | 16.27 | 2.27 | 141.18 | 354.82 | 5.69896 | 71.54 |
| 662.00 | 8.28 | 24.03 | 3.35 | 208.52 | 453.48 | 7.283649 | 68.50 |
| 840.00 | 7.47 | 32.72 | 4.56 | 283.93 | 556.07 | 8.931459 | 66.20 |
| 1040.00 | 6.91 | 38.39 | 5.35 | 333.13 | 706.87 | 11.35354 | 67.97 |

Double Tube Six Man Raft Results

| Measured Data | | | Tube Data | | | Floor Data | |
|---|---|---|---|---|---|---|---|
| Weight (lbs.) | Freeboard Height (in.) | X-Section Area in (sq. in.) | Volume Displaced (cu. ft.) | Buoyancy Force (lbs.) | Buoyancy Force (lbs.) | Volume Displaced cu. ft. | Bouyancy From Floor % |
| 1040.00 | 6.35 | 47.75 | 6.66 | 414.35 | 625.65 | 10.04899 | 60.16 |

As shown by the foregoing table, the buoyancy force of a floppy or droopy floor considerably enhances the buoyancy of the raft system. The single tube, six man raft, deck side up does not meet the governmental regulations of 6 inches of free board when fully loaded. The deck side down table and the double tube does meet government regulations.

It should be noted when two tubes are inflated, the raft can be configured as a reversible raft. This is important in airplane situations when the raft is ejected from the plane and there is not sufficient time to determine which is the proper "up" side of the raft.

The shape of the floor under water is very much dependent on the positions of the occupant load as the material will stretch to quite an extent. The general shape is conic or pyramidal if only material shape is considered. But once stretch is factored in, the shape becomes almost bowl like.

Analysis of Effect of Enhanced Buoyancy Floor (Floppy Floor)

| | Double Tube with Floppy Floor | Single Tube Deck Up with Floppy Floor | Single Tube Deck Down w/o Floppy Floor |
|---|---|---|---|
| No. of men* | 6 | 6 | 6 |
| Minimum floor area required* | 21.60 sq. ft. | 21.60 sq. ft. | 21.60 sq. ft. |
| Diameter of tube* | 11.00 in. | 11.00 in. | 11.00 in. |
| Maximum X-section under water fm. tbl.* | 42.02 sq. in. | 65.08 sq. in. | 65.08 sq. in. |
| Overall diameter of raft* | 85.00 in. | 85.00 in. | 85.00 in. |

-continued

Analysis of Effect of Enhanced Buoyancy Floor (Floppy Floor)

| | Double Tube with Floppy Floor | Single Tube Deck Up with Floppy Floor | Single Tube Deck Down w/o Floppy Floor |
|---|---|---|---|
| Resultant free board* | 6.35 in. | 3.88 in. | 7.28 in. |
| Total load | 1020.00 lbs. | 1020.00 lbs. | 1020.00 lbs. |
| Buoyancy volume needed (total) | 16.38 cu. ft. | 16.38 cu. ft. | 16.38 cu. ft. |
| Resultant tube volume under water | 5.84 cu. ft. | 9.04 cu. ft. | 4.43 cu. ft. |
| Resultant floor volume under water | 10.55 cu. ft. | 7.34 cu. ft. | 11.95 cu. ft. |
| Percent buoyancy from floor | 64.38% | 44.82% | 72.96% |

*Indicates empirical data.

The claims appended hereto are meant to cover modifications and changes within the spirit and scope of the present invention.

What is claimed is:

1. A raft with a water displacing floor comprising:

first and second peripherally disposed, inflatable tubes stacked one atop the other, said peripheral tubes when inflated defining a periphery and a substantially planar spatial area within said periphery of said raft, each one of said peripheral tubes, when inflated, having a substantially similar vertical, cross-sectional dimension;

a flexible floor having a surface area larger than said planar spatial area of said raft when said tubes are inflated and said flexible floor having a peripheral floor region entirely attached in a watertight seal near an interface between the stacked tubes, a lower region of said floor hanging below said peripheral floor region a distance at least 50% greater than said vertical cross-sectional dimension of either of said first and second tubes when said raft is elevated in a horizontal, free-standing position;

when said tubes are inflated, said planar spatial area of said raft and all said floor surface being free of all obstructing rigid elements and open to a load;

whereby said floor provides at least 50% of the total buoyancy of said raft when said raft is loaded, said floor buoyancy being provided by a predetermined volume of water being displaced by said floor in said loaded condition; and when said tubes are inflated and said raft is deployed in water, said raft forms an operable raft with said floor buoyancy when said first inflatable tube is principally buoyant in said water and forming a substantially identical operable raft with said floor buoyancy when said second inflatable tube is principally buoyant in said water.

2. A raft as claimed in claim 1 wherein said floor has said surface area larger than said planar spatial area of said raft such that said lower region of said floor hangs below said peripheral floor region a distance at least equal to said vertical cross-sectional dimension of one of said peripheral tubes when said raft is elevated in a horizontal, free-standing position.

3. A raft as claimed in claim 2 wherein peripheral floor region is attached in said watertight seal along an intersecting interface between said stacked first and second tubes.

4. A raft with a water displacing floor comprising:

a single, peripherally disposed, inflatable tube, said peripheral tube when inflated defining a periphery and a substantially planar spatial area of said raft, said peripheral tube when inflated having a vertical, cross-sectional dimension;

a flexible floor having a surface area larger than said planar spatial area of said raft and having a peripheral floor region entirely attached in a watertight seal to said peripheral inflatable tube, a lower region of said floor hanging below said peripheral floor region a distance at least 50% greater than said vertical cross-sectional dimension of said peripheral tube when said tube is inflated and said raft is elevated in a horizontal, free-standing position;

said floor being completely flexible in all directions due to an absence of any rigid elements therein;

when said tube is inflated, said planar spatial area of said raft and all said floor surface being fee of all obstructing right elements and open to a load and, whereby said floor provides at least 80% of the total buoyancy of said raft when said raft is loaded and said floor is water-side down, said floor buoyancy being provided by a predetermined volume of water being displaced by said floor in said loaded condition.

5. A raft as claimed in claim 4 wherein said floor has a surface area larger than said spatial area of said raft such that said lower region of said floor hangs below said peripheral floor region a distance at least equal to said vertical cross-sectional dimension of said peripheral tube when said tube is inflated and when said raft is elevated in a horizontal, free-standing position.

6. A method of enhancing a buoyancy of a raft carrying a load, said raft having at least two, stacked, peripherally disposed, inflatable tubes and a flexible floor attached to an interface between said tubes along a peripheral floor region, the method comprising the steps of:

inflating said tubes and establishing a substantially planar open spatial area of said raft;

providing said floor with a watertight seal at an intersecting interface between said stacked inflatable tubes, said floor having a surface area greater than said planar spatial area of said raft such that a lower region of said floor hangs below said peripheral floor region a distance at least 50% greater than the height of a lower one of said stacked inflated tubes when said raft is elevated in a horizontal, free-standing position;

floating the raft on water, creating a substantially water free, load bearing floor surface free of all obstructing rigid elements and open to said load, and loading said raft by placing said load on said floor;

buoyantly supporting at least 50% of said loaded raft with a displacement of water by said floor when a first of said two inflated tubes is water-side down; and buoyantly supporting at least 50% of said loaded raft with said displacement of water by said floor when a second of said two inflated tubes is water-side down;

thereby providing a raft with a significant floor buoyancy characteristic notwithstanding a deployment of the raft on said water.

7. A method as claimed in claim 6 including the step of:

permitting the raft to be loaded and the floor to displace water and buoyantly support at least 50% of said load irrespective of which peripheral inflated tube is in primary contact with and principally buoyant in said water.

8. A method as claimed in claim 6 including the step of further enhancing the buoyancy of said raft by providing said floor with a large surface area such that said floor hangs at least below said one of said peripheral tubes when said raft is elevated in a horizontal, free-standing position.

9. A method of enhancing a buoyancy of a raft carrying a load, said raft having a single, peripherally disposed, inflatable tube and a flexible floor attached to said tube along a peripheral floor region, the method comprising the steps of:

inflating said tube and establishing a substantially planar open spatial area of said raft;

providing said floor with a watertight seal between it and said inflatable tube, said floor having a surface area greater than said planar spatial area of said raft such that a lower region of said floor hangs below said peripheral floor region a distance at least 50% greater than the height of said inflated tube when said raft is elevated in a horizontal, free-standing position;

floating the raft on water, creating a substantially water free, load bearing floor surface free of all obstructing rigid elements and open to said load, the absence of obstructing rigid elements further creating a floor surface flexible in all directions due to an absence of any rigid elements therein, and loading said raft by placing said load on said floor;

buoyantly supporting at least 80% of said loaded raft with a displacement of water by said floor.

10. A method as claimed in claim 9 including the step of further enhancing the buoyancy of said raft by providing said floor with a large surface area such that said floor hangs at least below said peripheral tube when said raft is elevated in a horizontal, free-standing position.

* * * * *